US006794354B1

(12) United States Patent
Mort, III et al.

(10) Patent No.: US 6,794,354 B1
(45) Date of Patent: Sep. 21, 2004

(54) CONTINUOUS PROCESS FOR MAKING DETERGENT COMPOSITION

(75) Inventors: Paul R Mort, III, Cincinnati, OH (US); Millard Edward Sullivan, North Bend, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/786,936

(22) PCT Filed: Sep. 3, 1999

(86) PCT No.: PCT/US99/20182

§ 371 (c)(1),
(2), (4) Date: Mar. 12, 2001

(87) PCT Pub. No.: WO00/17304

PCT Pub. Date: Mar. 30, 2000

Related U.S. Application Data

(60) Provisional application No. 60/100,960, filed on Sep. 18, 1998.

(51) Int. Cl.[7] ..... C11D 11/00

(52) U.S. Cl. ..... 510/444; 510/349; 510/441; 510/443; 510/495; 510/498; 510/507; 264/117; 264/140

(58) Field of Search ..... 510/444, 509, 510/495, 441, 498, 443, 349, 507; 264/117, 140

(56) References Cited

U.S. PATENT DOCUMENTS

| | | | | | |
|---|---|---|---|---|---|
| 5,486,317 | A | * | 1/1996 | Dorset et al. | 510/444 |
| 5,573,697 | A | * | 11/1996 | Riddick et al. | 510/359 |
| 5,576,285 | A | * | 11/1996 | France et al. | 510/444 |
| 5,663,136 | A | * | 9/1997 | Van Dijk et al. | 510/444 |
| 5,668,099 | A | * | 9/1997 | Chapman et al. | 510/444 |
| 5,736,502 | A | * | 4/1998 | Wilkinson | 510/444 |
| 6,207,635 | B1 | * | 3/2001 | Adams et al. | 510/444 |
| 6,274,544 | B1 | * | 8/2001 | Akkermans et al. | 510/444 |

FOREIGN PATENT DOCUMENTS

| | | | |
|---|---|---|---|
| EP | 0 420 317 A1 | | 4/1991 |
| WO | WO 97/32954 | | 9/1997 |
| WO | WO 98/11193 | | 3/1998 |
| WO | WO 98/14555 | * | 4/1998 |
| WO | WO 98/14557 | * | 4/1998 |
| WO | WO 98/20104 | | 5/1998 |
| WO | WO 98/24876 | | 6/1998 |

* cited by examiner

*Primary Examiner*—Gregory Webb
(74) *Attorney, Agent, or Firm*—Brahm J. Corstanje; Marianne Dressman; Kim William Zerby

(57) ABSTRACT

A continuous process for preparing granular detergent composition including a first step of dry neutralizing an acid precursor of an anionic surfactant with a particulate water-soluble alkaline material in a high speed mixer for a mean residence time of about 0.2 to about 50 seconds, thereby partly or totally neutralizing the acid precursor and producing a dry neutralized material containing the anionic surfactant, in the form of a free-flowing powder; and a second stop of agglomerating the free-flowing powder into a detergent agglomerate using an agglomeration binder. The agglomeration binder is preferably a viscous surfactant paste binder. The resulting agglomerates are dry, free-flowing, and have a substantially more narrow particle size distribution, compared to the free-flowing powder, with reduced fine particles and over-sized particles that generally are recycled.

7 Claims, No Drawings

CONTINUOUS PROCESS FOR MAKING DETERGENT COMPOSITION

This application claims benefit of Provisional application No. 60/100,960 filed Sep. 18, 1998.

FIELD OF THE INVENTION

The present invention generally relates to a continuous, non-tower process for producing a particulate detergent composition. More particularly, the invention is directed to a continuous process where a free-flowing dry neutralized detergent powder is agglomerated with a liquid or viscous paste binder to form agglomerates. The process produces detergent agglomerate having a reduced amount of fine particles and over-sized particles that require recycle.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 500–600 g/l or higher. The low dosage detergents are currently in high demand as they conserve resources and can be sold in small packages which are more convenient for consumers. However, the extent to which modern detergent products need to be "compact" in nature remains unsettled. In fact, many consumers, especially in developing countries, continue to prefer a higher dosage levels in their respective laundering operations.

Generally, there are two primary types of processes by which detergent granules or powders can be prepared. The first type of process involves spray-drying an aqueous detergent slurry in a spray-drying tower to produce highly porous detergent granules (e.g., tower process for low density detergent compositions). In the second type of process, the various detergent components are dry mixed after which they are agglomerated with a binder such as a nonionic or anionic surfactant, to produce high density detergent compositions (e.g., agglomeration process for high density detergent compositions). In the above two processes, the important factors which govern the density of the resulting detergent granules are the shape, porosity and particle size distribution of said granules, the density of the various starting materials, the shape of the various starting materials, and their respective chemical composition.

There have been many attempts in the art for providing processes which increase the density of detergent granules or powders. Particular attention has been given to densification of spray-dried granules by post tower treatment. The following references are directed to densifying spray-dried granules: Appel et al, U.S. Pat. No. 5,133,924 (Lever); Appel et al, U.S. Pat. No. 5,164,108 (Lever); Bortolotti et al, U.S. Pat. No. 5,160,657 (Lever); Johnson et al, British patent No. 1,517,713 (Unilever); and Curtis, European Patent Application 451,894. As an example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been made to provide continuous processes for increasing the density of "post-tower" or spray dried detergent granules. Typically, such processes require a first apparatus which pulverizes or grinds the granules and a second apparatus which increases the density of the pulverized granules by agglomeration. The stochastic nature of most pulverizing and agglomeration processes often results in the undesired broadening of particle size distributions, resulting in both fine dusty particles and coarse oversize particles; this requires additional corrective process steps such as screening, elutriation, grinding and recycling in order to meet desired product specifications for particle size. As such, treating or densifying by "post tower" is not favorable in terms of economics (high capital cost) and complexity of operation. Moreover, all of the aforementioned processes are directed primarily for densifying or otherwise processing spray dried granules. In addition, products made by treating or densifying "post tower" or spray dried granules, in absence of other post-process steps such as spray-on coating, are typically limited in their ability to go higher in surfactant active level because of limitations inherent to the spray-drying process. Currently, the relative amounts and types of materials subjected to spray drying processes in the production of detergent granules has been limited For example, it has been difficult to attain high levels of surfactant in the resulting, detergent composition, a feature which facilitates production of detergents in a more efficient manner. Thus, it would be desirable to have a process by which detergent compositions can be produced without having the limitations imposed by conventional spray drying techniques.

To that end, the art is also replete with disclosures of processes which entail agglomerating detergent compositions. For example, attempts have been made to agglomerate detergent builders by mixing zeolite and/or layered silicates in a mixer to form free flowing agglomerates. Mixer/agglomerator processes can deliver high product throughputs; however, these products are typically either broad in their particle size distribution (i.e., they include dusty fines and coarse oversize) or they rely on substantial classification and recycle loops (e.g., recycle rate greater than 20% by weight of the production rate) to maintain a desired particle size distribution. See for example U.S. Pat. No. 5,516,448.

The following references are directed to producing detergents by agglomeration: Beujean et al, Laid-open No. WO93/23,523 (Henkel), Lutz et al, U.S. Pat. No. 4,992,079 (FMC Corporation); Porasik et at, U.S. Pat. No. 4,427,417 (Korex); Beerse et al, U.S. Pat. No. 5,108,646 (Procter & Gamble); Capeci et at, U.S. Pat. No. 5,366,652 (Procter & Gamble); Hollingsworth et at, European Patent Application 351,937 (Unilever); Swatling et at, U.S. Pat. No. 5,205,958; Dhalewadikar et at, Laid Open No. WO96/04359 (Unileaver). For example, the Laid-open No. WO93/23,523 (Henkel) describes the process comprising pre-agglomeration by a low speed mixer and further agglomeration step by high speed mixer for obtaining high density detergent composition with less than 25 wt % of the granules having a diameter over 2 mm. The U.S. Pat. No. 4,427,417 (Korex) describes continuous process for agglomeration which reduces caking and oversized agglomerates.

On the other hand, examples of processes to make detergent products with narrow particle size distributions by an extrusion/spheronization process are also known. However, these products are typically limited to particle sizes of about 1000 micron and above, and typically do not achieve throughput rates that are as high as mixer/agglomerator processes. While such attempts suggest that their process can be used to produce detergent agglomerates, they do not provide a mechanism by which starting detergent materials in the form of pastes, liquids and dry materials can be effectively agglomerated into crisp, free flowing detergent agglomerates, where the detergent product is characterized by i) high active level of chemical surfactants (i.e., generally more than 15 weight %), ii) particle size distribution of the agglomerates with a geometric mean particle size in the range between 250 to 1200 microns and a geometric standard deviation of less than 2.5, and iii) high bulk density (i.e., greater than 500 g/l); and by a detergent making process having a high throughput (i.e., greater than 1 metric ton/hour) continuous process, where the process is efficient by virtue of its minimal reliance of recycle streams (i.e., less than 20 weight % of the product rate) for product that is either too fine (e.g., less than 250 microns) or too coarse (e.g., greater than 1400 microns) in particle size.

Accordingly, there remains a need in the art to have a non-tower process for continuously producing a detergent composition delivered directly from starting detergent ingredients, where the density of the resulting detergent composition can be achieved by adjusting the process condition. Also, there remains a need for such a process which is more efficient, flexible and economical to facilitate large-scale production of detergents (1) for flexibility in the ultimate density and particle size of the final composition, (2) for incorporating high levels of detergent surfactant into the final composition, and (3) for flexibility in terms of incorporating several different kinds of detergent ingredients (especially liquid ingredients) into the process.

SUMMARY OF THE INVENTION

The present invention provides a continuous process for preparing a granular detergent agglomerate having a density of at least about 500 g/l, comprising the steps of:

(a) in a first step, dispersing and mixing a liquid acid precursor of an anionic surfactant with a solid particulate water-soluble alkaline material in a high speed mixer for a mean residence time of about 0.2 to about 50 seconds, wherein the acid precursor is partly or totally neutralized, thereby forming a dry neutralized material comprising a salt of the anionic surfactant precursor in the form of a free-flowing powder; and (b) in a second step, dispersing and mixing an agglomeration binder with the free-flowing powder in a moderate speed mixer, thereby of agglomerating the powder into granular detergent agglomerates.

The present invention produces high density detergent agglomerates for use in granular detergent compositions, having a high level of detergent surfactant and a relatively narrow particle size distribution. Furthermore, the process is inherently efficient by significantly reducing the amount of agglomerate which is outside an acceptable particle range. The present invention also meets the aforementioned needs in the art by providing a process which produces a granular detergent composition for flexibility in the ultimate density of the final composition from an agglomeration (e.g., non-tower) process. The process does not require the use of conventional spray drying towers which have limited capability to produce compositions having a high surfactant loading (concentration) at high bulk density (greater than 500 gm/l).

Accordingly, it is an object of the invention to provide a process for continuously producing a detergent composition which has flexibility with respect to bulk density, size, size distribution, chemical composition and surfactant active level of the final products by controlling residence time, mixing element tip speed and binder dispersion conditions in the mixers. It is also an object of the invention to provide a process which is more efficient, flexible and economical to facilitate large-scale production.

The process described herein provides a granular detergent agglomerate having a high density of at least about 500 g/l and relatively narrow particle size distribution as measured by the geometric standard deviation of less than about 2.5, with high throughput capability and increased production efficiency, and with less recycle of material having an unacceptable particle size. While it is recognized that other processes which include classification and recycle loops are capable of producing more narrow particle size distributions measured at the final product output, the advantage of the current invention is the narrowness of the particle size distribution before any classification is done.

DETAILED DESCRIPTION OF THE PREFERRED EMBODIMENT

Definitions:

As used herein, the term "agglomerates" refers to particles formed by agglomerating particulate detergent materials with a binder such as surfactants and/or other solutions, whereby the agglomerate particle has a larger size than the particulate detergent materials contained therein.

As used herein, the term "mean residence time" refers to following definition: mean residence time (hr)=mass (kg)/flow throughput (kg/hr). The residence time can be easily and conveniently determined by measuring the steady-state weight of agglomerate powder and ingredients in a mixer (in kg), and dividing by the mass throughout (in kg/minute) of the mixer.

As used herein, the term "particle size distribution" refers to the mass-basis distribution of agglomerate particle sizes, where the distribution is described by the geometric mean and geometric standard deviation. The mass-basis geometric mean and standard deviation are, most commonly measured using standard sieve analysis methods.

All percentages used herein are expressed as "percent-by-weight" unless indicated otherwise. All ratios are weight ratios unless indicated otherwise. As used herein, "comprising" means that other steps and other ingredients which do not affect the result can be added. This term encompasses the terms "consisting of" and "consisting essentially of".

The Process

The present invention is directed to a continuous process which produces free-flowing, granular detergent agglomerates. The process can produce a product having a density of at least about 500 g/l, a narrow product size distribution at the output of the agglomeration step, and improved process, efficiency by virtue of its low recycle rate.

First Step (Dry Neutralization)

The first step of the process prepares a dry neutralized material in the form of a free-flowing powder. The dry neutralized material is obtained by the dry neutralization of an acid precursor of an anionic detergent surfactant with a water-soluble alkaline inorganic particulate material in a high speed mixer, whereby the acid precursor is partially or completely neutralized to the anionic surfactant. Preferably, an excess of the alkaline inorganic particulate material is used to ensure that the acid precursor is sufficiently neutralized under the high speed mixing conditions. The excess of alkaline inorganic particulate material, and the preferred presence of other particulate inorganic or organic detergent ingredients present in the high speed mixer during the dry neutralization step, tend to produce a substantially dry, fine particle-sized, free-flowing powder material, which is generally both too dusty and too dense to incorporate directly into a detergent product.

A particulate water-soluble alkaline inorganic material is continuously introduced into the high speed mixer in the form of fine particles. Simultaneously, a liquid acid precursor of the anionic surfactant is introduced into. the mixer and is well dispersed and adsorbed onto the surface of the fine particles of the alkaline inorganic material. Neutralization of the acid precursor to the corresponding salt occurs quickly. The rate and capacity for neutralization of the acid precursor to the salt increases as the alkaline inorganic material is reduced to a finer particle size with a higher reactive surface area. Because of the inherent binding capacity of the liquid, there is typically some intermediate agglomeration associated with the first step to form the dry neutralized material. The extent of this intermediate agglomeration is controlled primarily by the amount of liquid addition and the shear rate of the mixer. The mean particle size of the dry neutralized material is generally within the range of about 50 to 500 microns, preferably about 100 to 250 microns. Generally, the bulk density of the dry neutralized material of the first mixer is at least 500 g/l, more typically at least 600 g/l, and preferably from about 650 to 800 g/l.

To achieve the desired intimate dispersion and adsorption, it is necessary that the shear rate in the mixer be high and proportional relative to the viscosity of the liquid ingredients. In a preferred embodiment, the mixer consists of a device with mixing tools operating at a tip speed of at least 10 m/s, and a narrow gap between the tool tip(s) and the mixer wall or other fixed element of less than 2 cm. Preferably, the mean residence time of the first mixer is in range from about 0.2 to about 50 seconds, more preferably from about 1 to about 30 seconds. Examples of the high speed mixer for the first step are a Lödige CB Mixer manufactured by the Lödige company (Germany), a Turbilizer manufactured by Bepex Company (USA), and a Schugi Flexomatic (e.g., Model FX-160) manufactured by the Schugi company (Netherlands).

The particulate water-soluble alkaline material is preferably sodium carbonate, alone or in combination with other materials such as sodium bicarbonate or silicate. Alkaline materials having other salts, such as lithium and potassium, can also be used. While aqueous alkaline materials such as sodium hydroxide can also be used in combination with the particulate alkaline material, their use should minimized to prevent the resulting intermediate agglomerate from being sticky or poor flowability. The carbonate is preferably of a finely divided powder having an mean diameter of from 0.1 to 100 microns, preferably from 2 to 25 microns, and more preferably from 5 to 15 microns. Typically the moisture content of the carbonate will be less than about 2%, more preferably less than 1%. The carbonate can comprise from about 25% to about 80% by weight of the resulting agglomerate, preferably about 30% to about 60%.

A preferred method of reducing the carbonate to the finely divided size is by the use of a suitable grinder capable of producing such finely ground carbonate from commercially available carbonate, stock, such as the process described in WO 98/20104, published May 14, 1998, and incorporated herein by reference. Commercially available carbonate typically has a median particle size of about 50–150 microns, and contains less than 2%, preferably less than 1% moisture. A preferred grinder used for this purpose is an air-classifier mill, such as the Mikro-ACM CX Model 300 available from Hosokawa Micron Powder Systems, Summit, N.J.

The particle size distribution of the ground carbonate is determined by any instrument which approximates such particle size as the diameter of a spherical particle occupying the same volume as the particle being measured. The median particle size is that size which has 50% by volume of the particles being smaller and 50% by volume being larger. A suitable instrument for measuring the particle size of the ground carbonate is the Malvern Series 2600 Optical Laser, available from Malvern Instrument Company, Malvern, Pa.

The amount of alkaline inorganic material is preferably in an amount to neutralize at least 80% of the acid precursor by the time the material leaves the first mixer. Typically, the stoicheometric amount of alkaline inorganic material will be at least twice that needed to fully neutralize the acid precursor. The neutralization of the acid precursor with alkaline powder by dispersion/adsorption is well known in the art. See "Synthetic Detergents", A. S. Davidsohn & B. Midlewsky, 7th ed., pp 202–209. The amount of liquid acid precursor that can be added in this step is up to about 30 weight %. It should be noted that higher levels of acid precursor can be added by using micronized powders such as sodium carbonate ground in an air-classifier mill, as described herein before. For acid precursors of detergent surfactants that are more crystalline than alkylbenzene sulfonate, such as alkyl sulfuric acid, generally more of acid precursor can be loaded into the mixer.

The liquid acid precursor preferably selected from a conventional $C_{11}$–$C_{18}$ alkylbenzene sulfonic acid ("HLAS"), a primary, branched-chain and random $C_{10}$–$C_{20}$ alkyl sulfuric acid ("HAS"), the $C_{10}$–$C_{18}$ secondary(2,3) alkyl sulfuric acid of the formula $CH_3(CH_2)_x(CHOSO_3^-H^+)CH_3$ and $CH_3(CH_2)_y(CHOSO_3^-H^+)CH_2CH_3$ where x and (y+1) are integers of at least about 7, preferably at least about 9, unsaturated alkenyl sulfuric acid such as oleyl sulfuric acid, and a $C_{10}$–$C_{18}$ alkyl alkoxy sulfuric acid ("$HAE_xS$"; especially EO 1–7 ethoxy sulfuric acid). Most preferred are HLAS and HAS. Methods of making the above acid precursors are well known in the art. Preferably the acid precursor comprises at least 50% of HLAS. Preferably, at least 50% by weight of the detergent surfactant in the final detergent product is derived from the neutralization of the acid precursor in the first step.

In addition to the alkaline inorganic material, other particulate inorganic and organic detergent ingredients can be added into the first step mixer. Such other particulate detergent ingredients are described herein after. The addition of the other particulate detergent ingredients into the process can improve the physical properties of the dry neutralized material. However, it may be preferred to use only the particulate water-soluble alkaline material in the first step, absent or with only minimal amounts of any other particulate inorganic materials, and specifically any particulate detergent builder material such as phosphate, polyphosphate, and aluminosilicate. In this case, the dry neutralized material will contain less than about 5% by weight of such particulate builder material.

In the high speed mixer, it is preferred that some free water be present to initiate and sustain the neutralization reaction between the acid precursor and the alkaline inorganic material. Typically, this is some small amount, for example, about 1% of free water present in the acid precursor liquid. When the alkaline inorganic material (carbonate) has been finely divided as described above, it is generally not necessary to add any additional free water to the mixture to initiate and maintain the neutralization reaction. The moisture content of the reaction mixture, defined as water not firmly bound as water of hydration or crystallization to inorganic salts at a temperature of 135° C., should not be so high that it can lead to substantial agglomeration of the powders. Generally, the moisture content of the powder material in the first mixer will be less than about 5%, more preferably less than about 2%.

As a result of the dry neutralization first step, a detergent material is obtained containing the salt of the anionic surfactant, wherein preferably at least 80%, more preferably at least 90%, and most preferably all, of the acid precursor of the anionic surfactant has been neutralized.

The detergent material exiting the first mixer can optionally be processed in an optional intermediate step, before passing as the free-flowing powder into the agglomeration mixer of the second step. Such intermediate step can be a mixing step where optional liquid or particulate materials can be added. Such optional liquid material is generally added at a level of less than 10% by weight of the free-flowing powder, and can include nonionic surfactants or other binder liquids herein described. Such optional particulate material can be a free-flow aid, such as zeolite or a carbonate. The mixer can be a static mixing device such as a baffled box mixer, or a mechanical mixer such as a Schugi, drum or cage mixer. Such optional step can be advantageously used to add a liquid material (as in the case of a nonionic surfactant) that may interfere with effective dry neutralization of the acid precursor in the first step, or with effective agglomeration in the second step.

Second Step (Agglomeration)

The second step prepares a granular detergent agglomerate from the free-flowing powder and an agglomerating binder. The resultant free-flowing powder from the first step is fed into a second mixer The second mixer is preferably a completely separate mixer, though it can be a subsequent down-stream zone of the first mixer, so long as it satisfies the mixing conditions. The second step comprises dispersing an agglomeration binder onto the free-flowing powder of the first step to form the detergent agglomerate. The amount of the agglomeration binder used can be from about 1% to about 50% (active basis), preferably from 5% to about 35% (active basis) by weight of the detergent agglomerates. The invention can accommodate a broad range of surfactant paste levels based on rheological properties and modifications thereof in the process. The resulting detergent agglomerates have a mean particle size of about 250 microns to about 1200 microns, more preferably about 400 microns to about 1000 microns, and a relatively narrow particle size distribution at the output of the second agglomeration step having a geometric standard deviation of less than about 2.5, preferably less than about 2.0.

It is preferred to operate the second step of the process at an operating temperature sufficiently high to promote effective agglomeration of the free-flowing powder with the agglomeration binder, though not so high in temperature such that there is excessive agglomeration or "balling" of the powder into large clumps. Typically the operating temperature of combined material of the second step, within the second mixer, is from about 30 to 70° C. The temperature of the agglomeration binder, typically in the range from about 20 to 70° C., can be controlled independently such that the agglomeration binder can be in the form of either a flowable liquid, which can be sprayed or dripped into the mixing zone of the second mixer, or a thick viscous paste which needs to be mechanically dispersed into particles within the mixing zone. In one method, the flowable liquid agglomeration binder can be sprayed on the agglomerates in the second mixer using single fluid or air-atomizing spray nozzles, which can be easily selected for the service required. The flowable liquid can also be dripped or introduced into the mixer as a stream of liquid from a pipe. It is important that the flowable liquid, though, be well dispersed and distributed within the powder in order for the powder particles to efficiently and effectively adhere to and coat the outer surface of the agglomeration binder.

In the case of thick viscous paste binders, another method is to inject the binder in a series of narrow paste streams, where the pastes streams are aimed directly at one or more high speed chopper blades positioned in the mixer. Typical tip speed of the chopper blades is at least about 3 m/sec, preferably greater than about 15 m/sec, and more preferably greater than about 20 m/sec. Typical chopper designs include at least four radial blade positions. This is well suited to the ploughshare design of mixers with internal choppers, for example a Lödige KM mixer manufactured by the L ödige company (Germany). Mixers can be equipped with lance tubes through which a binding fluid can be injected onto the chopper locations. In the current invention, the lance tubes can be sub-divided into smaller diameter tube streams, where the cross sectional area of the openings of each (sub-divided) stream is less than about 80 $mm^2$, most preferably less than about 1 $mm^2$. In this preferred embodiment, the combination of paste injection rate divided across the number of streams and the chopper cutting speed results in cutting of the individual streams into fine units of binder, where the calculated volume of paste in each stream per cut is less than about 1 ml, most preferably less than about 0.01 ml, and most preferably from about 0.00005 ml to about 0.01 ml, or an average equivalent diameter of less than about 13 mm, and more preferably less than about 4 mm. Binder particles of this size are torn apart into smaller sizes within the second mixer as a result of the coating and embedding of the finely-divided powder onto the binder particle, until the agglomerate achieves a size within a range where the strength of the agglomerate particle will resist further reduction. This agglomerate size range is generally from about 50 microns to about 2000 microns, and spans beyond the range of acceptable average detergent particle size (about 250 to 1200 microns) to include both fines (agglomerates and particles less than 250 microns) and overs (agglomerates greater than 1400 microns).

It is most preferable to form and disperse the agglomeration binder into droplets or particles having an equivalent diameter of from about 0.5 mm to about 1 mm. This particle size is comparable to the size-of the desired detergent agglomerate. Binder particles within this size range will tend not to be torn into smaller sizes. The result of dispersing the agglomerate binder within this size range will be a resulting detergent agglomerate having a significantly narrower particle size range, with minimal amounts of overs and fines.

The binder volume per cut can be calculated from the cutting rate, and the binder volume rate. The cutting rate, in cuts/sec, is "chopper revolutions/sec×chopper blades/revolution", where each chopper blade makes a cut. The binder volume rate, in ml/sec, is "binder mass/binder density", where the binder mass is in kg/sec, and the binder density is in kg/ml. The binder volume per cut is then "binder volume rate/cutting rate".

The tubes that are used to inject the (sub-divided) binder streams are located such that their discharge openings are slightly upstream of the choppers; in this way, the ploughshare tools in the mixer sweep the binder streams and intermediate particles into the choppers, where the binder is finely divided and coated with powder.

Another embodiment is to supplement the above sub-divided binder injectors with additional mechanisms to disperse the binder, such as by the addition of compressed air in the binder line at or before the opening of the binder tube into the mixer. The air may be further pulsed to provide additional breakup of the binder stream into uniform pieces. Further, vibrating elements such as reeds can be used at the injection point to further improve the uniformity of the binder dispersion.

It may be convenient to raise the feed temperature of the flowable liquid binder to temperatures at or above the operating temperatures, in order to reduce the viscosity and improve the dispersion and pumpability. It is within the skill of the artisan to select liquid binder feed temperatures which optimize the processing conditions yet avoid problems with instability or thermal decomposition of the binder.

The most preferred embodiment uses a viscous surfactant paste binder, characterized by a shear-rate thinning viscosity that exhibits an apparent yield stress. The shear-rate thinning property is advantageous to transport of the paste binder, typically from a storage tank, into the mixer/agglomerator. The apparent yield stress property is important in mechanical cutting of the paste as well as in maintaining the structural integrity of the as-formed agglomerates, especially at high active levels of the binder.

The shear-rate thinning and apparent yield stress properties can be measured in accordance with accepted practice in the art of rheological characterization, for example, using a parallel plate or cone and plate viscometer. The viscometer is typically determined using a stress ramp program, where stress ($\tau$) is increased from about 10 Pa to about 1000 Pa over a ramp time of about 10 minutes, and the resultant strain rate ($\gamma$) is measured. The apparent viscosity ($\eta$) is calculated over the range of stress and strain-rate data as follows:

$$\eta = \frac{\tau}{\dot{\gamma}}$$

The logarithm of the calculated viscosity is then plotted against the logarithm of shear rate. For a shear-thinning paste with a yield stress behavior, regression of log($\eta$) versus log($\gamma$) typically results in a good linear fit in the strain rate range from about 0.1 to about 10 sec $^{-1}$. More specifically, the correlation coefficient of the regression, $r^2$, is typically greater than 0.99. The downward (negative) slope of the log-log plot is indicative of shear-thinning behavior, i.e., the viscosity falls as the shear rate increases. The viscosity of yield-stress fluids are typically dominated by the yield-stress effects in this range of shear rates. This is characteristically indicated by a regression slope value approaching a value of −1, generally in the range from −0.7 to −1.0. For the purposes of the present invention, the apparent yield stress ($\tau_\gamma$) is defined as the product of the viscosity and the shear rate at the shear rate value of 1 sec$^{-1}$. In, order to provide good dispersion of the paste binder by mechanical cutting the value of the apparent yield stress, $\tau_{65}$, should be greater than about 20 Pa, preferably greater than about 50 Pa, and more preferably greater than about 100 Pa. In general, the apparent yield stress of paste binders increases with a reduction in temperature, whereby the agglomerates can have improved physical integrity and be more resistant to smearing as the product cools.

In addition, the preferred paste binder has a viscoelastic rheology that can be characterized by a complex shear modulus (G*), which is the vector sum of its elastic storage (G') and viscous loss (G") parts. The ratio of the viscous loss modulus to elastic storage modulus is described by the tangent of the phase angle ($\delta$), tan($\delta$)=G"/G'. The preferred embodiment employs a paste binder with a tan($\delta$) value that is less than 1.0, more preferably less about 0.5, over the frequency range of about 2 Hz to about 20 Hz. The decreasing value of tan($\delta$) below 1.0 means that the elastic storage modulus becomes increasingly dominant over the viscous loss modulus. The dominance of the elastic storage modulus aids in the mechanical cutting the paste and dispersion of the paste as discrete units of binder. Dispersion of highly viscoelastic binder as discrete mass units favors the formation of agglomerates by embedding powder into the discrete units of binder. In addition, the low value of tan($\delta$) helps to reduce the tendency for the binder to smear over the surface of the agglomerates and the internal mechanical elements of the medium-shear mixer. The reduction of smearing is advantageous in improving the operating efficiency of the process by reducing the tendency for product to make-up and adhere to the inside of the mixer. The above viscoelastic rheology data can be measured by one skilled in the art of rheology using oscillatory parallel plate viscometers.

The high viscosity, apparent yield stress and viscoelastic nature of the viscous agglomeration binder is well suited to a mechanism of agglomeration wherein the solid particles coat, adhere and are embedded into the binder. In this case, the mixing shear of the process needs to be sufficient only to coat and embed the particles into the finely divided droplets or particles of binder; as such, the mixing shear in the second mixer is intentionally kept below a point that would extensively spread the binder over the surface of the particles.

As in the case of a more flowable liquid binder, it is important that a viscous binder be well dispersed and distributed within the free-flowing powder in order for the powder particles to efficiently and effectively adhere to and coat the outer surface of the agglomeration binder. Also as in the case of liquid binders, it may be convenient to raise the feed temperature of the viscous binder to temperatures above the operating temperatures (i.e., above about 70° C.) in order to reduce the viscosity and possibility allow the binder to be pumped to the mixer. In the case of viscous binders where the material can not feasibly be raised to a temperature that allows the material to be pumped and/or sprayed in the mixer, it will generally be required to provide a means of mechanically dispersing the binder, such as a cutting and/or shredding device. Another embodiment which is especially preferred for very stiff binders is the use of a pelletizing extmider to deliver small, uniform pellets of binder into the agglomeration mixer. This embodiment includes the use of both single and twin-screw extruders. In this case, the extruder can be used to beneficially stiffen the binder before it is injected into the mixer, as disclosed U.S. Pat. No. 5,451,354, incorporated herein by reference. In this embodiment, the dispersion of the binder is accomplished by extruding the binder through a die plate with many small openings, producing noodles of binder which are then fed into the agglomeration mixer. Optionally, the noodles can be cut into pellets before being fed into the mixer, using a variety of cutter configurations that are well known in the art of extrusion/pelletization. A more preferred embodiment uses a fine noodle size, with a noodle cross sectional area less than about 10 mm$^2$ and a chopper configured to chop the noodles into short lengths of less than about 4 mm. A most preferred embodiment uses an even finer noodle size, with a noodle cross sectional area less than about 1 mm$^2$ and a chopper configured to chop the noodles into short lengths of less than about 1 mm.

In general, the more uniformly in size the agglomerate binder is dispersed as particles or droplets, the more uniformly in size will be formed the detergent agglomerates from the second mixer. Said differently, the more narrow the particle or droplet size distribution of the agglomeration binder, the more narrow the size distribution of the detergent agglomerate.

The agglomeration binder can be selected from the group consisting of anionic surfactant paste (which is most preferred), liquid silicate, cationic surfactants, aqueous or non-aqueous polymer solutions, water, and mixtures thereof. Preferred examples of anionic surfactant solutions as the agglomeration binder are about 30–95% active NaLAS, having an alkyl chain of about 12–18 carbons; about 30–95% active NaAS, having an alkyl chain of about 12–18 carbons; about 30–95% active NaAS, having a branched alkyl chain of about 10–20 carbons; and about 20–95% active NaAExS solution, having an alkyl chain of about 10–18 carbons, and where x is from about 1–10, and a mixture of the above surfactant solutions having a net active level of 30 to 95%. More preferred are NaAS and NaLAS surfactants having an alkyl chain from about 14–15 carbons, and about 70–80% active, and AExS surfactants having an alkyl chain from about 12–14 carbons, an x of about 3, and about 70–80% active. Other minor ingredients, such as polyethylene glycol, organic polymers, silicates and alkaline salts may be present in the paste compositions.

Cationic surfactants can be quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups. Other binders can be those disclosed in U.S. Pat. No. 5,108,646 (Beerse et al.), and are herein incorporated by reference.

Additional particulate detergent ingredients of the type used in the first step can optionally be added into the second step mixer, along with the free-flowing powder, and agglomerated with the binder. About 0–10% particulate detergent ingredients, more preferably about 2–5%, by weight of the detergent agglomerate is typically added to the second mixer.

The second agglomeration mixer can be any types of mixer known to persons skilled in the art, as long as the mixer can maintain the above mentioned condition for the second step. Preferred is a second mixer which conducts the second step under conditions that include (i) from about 10 seconds to about 15 minutes, more preferably from about 1 minute to about 2 minutes, of mean residence time, (ii) a tip speed of a mixing tool mounted within the mixing zone of about 0.5 to about 5 m/s; and (iii) from about 0.15 to about 7 kj/kg of specific energy condition. A preferred example of the second mixer is the Lödige KM Mixer manufactured by the Lödige company (Germany).

Generally, the free-flowing powder of the first step is introduced directly into the second mixer, though optionally is can first be handled or processed thorough other mixing or transporting equipment, as herein before described.

As the result of the above two step process, a resultant product is obtained having a bulk density of at least 500 g/l. Optionally, the resultant product can be further subjected to drying, coating, fluid bed agglomeration, and/or cooling. Surprisingly, the particle size distribution of the product exiting the second stage mixer is more narrow, particularly compared to the free-flowing powder. The narrow particle size distribution means that the product exits the second mixer with a higher weight fraction of particles in the acceptable size range; thus, the overall process can be run with a lower rate of recycle for fines (very small size particles) and overs (larger sized particles), providing higher throughput and more efficient operation. In addition, with a surfactant acid precursor added in the first step, and a surfactant paste binder added in the second step, the resultant agglomeration product can be made with a significantly higher active level of surfactant, compared to single stage agglomeration using only one type of binder.

The total amount of the detergent surfactants in the detergent agglomerates made by the present invention, which are included via the first step acid precursor, the second step surfactant paste agglomeration binder, and adjunct detergent ingredients, is generally from about 5% to about 80%, more preferably from about 10% to about 60%, more preferably, from about 15 to about 50%, by weight. The amount of the surfactant that is formed by dry neutralization of acid precursor in the present process can be from about 5% to about 40%, though is more preferably from about 10% to about 30%, and most preferably from about 15% to about 25%, by weight of the agglomerate product.

Nonlimiting examples of the preferred anionic surfactants formed by the dry neutralization of the acid precursor in the first step of the present invention include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)\ CH_3$ and $CH_3\ (CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

In the case that the process of the present invention is carried out using (1) CB and/or Schugi mixer(s) which have flexibility to inject at least one liquid ingredient per mixer, (2) KM mixer with chopper blades which has flexibility to inject at least one paste binder ingredient, (3) an optional extruder/pelletizer which has flexibility to inject at least one additional paste binder ingredient into the KM, the process can incorporate at least four different kinds of liquid ingredients over a wide range of viscosity and other rheological properties in the process. Therefore, the proposed process is beneficial for persons skilled in the art in order to incorporate into a granule making process starting detergent materials which are in liquid form and are rather expensive and sometimes more difficult in terms of handling and/or storage than solid materials.

Optional Other Detergent Surfactants:

Optional other detergent surfactant can also be included in the detergent product, such as other anionic surfactants, nonionic surfactants, zwitterionic surfactants, ampholytic surfactants and cationic surfactants, and compatible mixtures thereof. Such other detergent surfactants can be added as liquids or powders in small amounts (generally, 10% or less) in the first or second step, or in any optional intermediate or finishing step. Detergent surfactants useful herein are described in U.S. Pat. No. 3,664,961, Norris, issued May 23, 1972, and in U.S. Pat. No. 3,929,678, Laughlin et al., issued Dec. 30, 1975, both of which are incorporated herein by reference. Useful cationic surfactants also include those described in U.S. Pat. No. 4,222,905, Cockrell, issued Sep. 16, 1980, in U.S. Pat. No. 4,239,659, Murphy, issued Dec. 16, 1980, both of which are also incorporated herein by reference. Cationic surfactants can also be used as a detergent surfactant herein and suitable quaternary. ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Particulate Inorganic or Organic Detergent Ingredients

The particulate inorganic or organic detergent ingredients that can be introduced into either one or more of the first step, the second step, or other optional step, are preferably in the form of a finely divided, free-flowing powder, and are preferably selected from the group consisting of ground soda ash or carbonates (including the excess of alkaline inorganic particulate material added in the first step), powdered sodium tripolyphosphate (STPP), hydrated tripolyphosphate, ground or powdered sodium sulphate, aluminosilicate, crystalline layered silicates, nitrilotriacetates (NTA), pyrophosphates, orthophosphates, precipitated silicates, polymers, other carbonates, citrates, the above-mentioned powdered surfactants (such as powdered alkane sulfonic acids) and internal recycle stream of powder occurring from the process of the present invention, wherein the mean diameter of the powder is from 0.1 to 500 microns, preferably from 1 to 300 microns, more preferably from 5 to 100 microns. In the case of using hydrated STPP as the fine powder of the present invention, STPP which is hydrated to a level of not less than 50% is preferable. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

The particulate inorganic or organic detergent ingredients can also serve as a coating agent when added to the second mixer. Preferred as coating agents are phosphates, carbonates and aluminosilicates. The coating agent enhances the free flowability of the resulting agglomerate and can prevent or minimize over-agglomeration in the second mixer. It can be advantageous to include only carbonate or other particulate material that is not a builder material, whereby a detergent agglomerate can be made that contains little (less than 10%, preferably less than 5%, by weight) or no detergent builders. This can enable the manufacturer to process a single detergent agglomerate for use in either phosphate-built or non-phosphate built detergents.

Preferably, the aluminosilicate ion exchange material is in "sodium" form since the potassium and hydrogen forms of the instant aluminosilicate do not exhibit as high of an exchange rate and capacity as provided by the sodium form. Additionally, the aluminosilicate ion exchange material preferably can be in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/gram/gallon to about 6 grains $Ca^{++}$/gallon/minute/-gram/gallon.

The amount of the particulate inorganic or organic detergent ingredients that can be present in the first step comprise from about 30 to 94%, preferably from 50% to 90%, by weight of the detergent agglomerate exiting the second step. An additional amount of the particulate inorganic or organic detergent ingredients can be added in any optional intermediate step, or in the second step, as to provide a dusting or free-flow material.

Adjunct Detergent Ingredients

Additional detergent can be incorporated in the detergent composition during subsequent steps of the present process. These adjunct ingredients include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Optional Process Steps

The process of the present invention can be used to make detergent agglomerates which are suitable for use as-is, after addition of any adjunct detergent ingredients, as a detergent product. However, it may be preferred to further condition or treat the detergent agglomerate via optional process steps. Such optional process steps can include screening any oversized detergent agglomerates in a screening apparatus which can take a variety of forms including but not limited to conventional screens chosen for the desired particle size of the finished detergent product. Another optional step, particularly when loading high levels of anionic paste in the agglomeration step, includes conditioning of the detergent agglomerates by subjecting the agglomerates to additional drying, such as can be accomplished with an airlift or a fluid bed dryer.

Optionally, an internal recycle stream of fine agglomerates, having a mean diameter of about 75 to 400 microns generated by elutriation from a device such as a fluidized bed dryer, fluidized bed cooler, or other classification device, can be fed into the first step mixer or second step mixer as one of the fine powders. The amount of such internal recycle stream can be 0 to about 60% by weight of final product stream on an instantaneous basis, and preferably less than about 20% by weight on an average production basis.

The process generally entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

EXAMPLES

Example 1

[Step 1] 222 kg/hr of liquid acid precursor HLAS (97% active) is continuously dispersed and mixed by the pin tools of a Lödige CB-30 mixer along with 297 kg/hr of ground soda ash (mean particle size of 15 microns), 295 kg/hr of powdered zeolite (mean particle size of about 5 microns), 10 kg/hr of ground sodium sulfate (mean particle size of 15 microns), and less that 20% (by weight of the CB mixer throughput) an internal recycle stream of powder from step 2. The acid precursor is fed at about 40° C., and the powders are fed at room temperature. The conditions of the CB-30 mixer are as follows:

Mean residence time: about 5 seconds

Tip speed: about 20 m/s

The dry neutralization of the acid precursor by the carbonate in the presence of the other particulate material results in a free-flowing powder. The free-flowing powder has a mean particle size of about 290 microns, a geometric standard deviation of about 2.1, and a bulk density of about 730 g/l.

[Step 2] The free-flowing powder from the CB-30 mixer is fed continuously to a Lödige KM-600 mixer having four internal chopper assemblies along its length, each chopper assembly having three levels choppers of 4 blades each (4 cuts per chopper assembly level per chopper revolution). A surfactant paste blend of about 48% NaAS paste (C14.5 sulfate, sodium salt; 75% active) and about 52% NaAES paste (C14.5 ethoxy-1 sulfate, sodium salt; 75% active) is prepared. Such a surfactant paste blend has been determined to have an apparent yield stress of 78 Pa at a shear rate of 1 sec⁻and a temperature of 60° C., as measured using a Carrimed CSL-100 Controlled Stress Rheometer. The paste binder is continuously injected at a temperature of about 60° C. across the first three choppers assemblies at a total rate of 175 kg paste/hr. Each paste stream to each chopper assembly is sub-divided into three smaller streams, each directed at a separate level of chopper, where each smaller stream has a discharge opening of 2 mm diameter. Each chopper turns at about 3500 RPM. The calculated mass of the discrete mass units of paste is about 0.023 grams, which is equivalent to a equivalent spherical diameter of about 3.4 mm. The conditions of the KM-600 mixer are as follows:

Mean residence time: about 60 seconds

Tip speed of plowshares: about 2 m/s

The resulting granular detergent agglomerates from the step 2 has a bulk density of about 630 g/l, a mean particle size of 510 microns, a geometric standard deviation of 1.9, and an anionic surfactant level of about 37% by weight. The agglomerates are processed using the optional process steps of drying and cooling in a fluidized bed, and sizing using particle separation means. After sizing, the resulting acceptable agglomerate ("accept") rate is about 90% (10% by weight recycle), where the acceptable size range is a particle size between about 150 and 1180 microns. The resulting acceptable agglomerates have a mean particle size of about 550 microns, a geometric standard deviation of the particle size distribution of about 1.7, and a bulk density of about 680 g/l. Unacceptable large particles are ground in a mill before recycling along with unacceptable fine particles back to step 1.

Example 2

[Step 1] 231 kg/hr of liquid acid precursor HLAS (97% active) is continuously dispersed and mixed by the pin tools of a Lödige CB-30 mixer along with 586 kg/hr of ground soda ash (mean particle size of 15 microns), and less that 20% (by weight of the CB mixer throughput) an internal recycle stream of powder from step 2. The acid precursor is fed at about 40° C., and the powders are fed at room temperature. The conditions of the CB-30 mixer are as follows:

Mean residence time: about 5 seconds

Tip speed: about 20 m/s

The dry neutralization of the acid precursor by the carbonate results in a free-flowing powder. The free-flowing powder has a mean particle size of about 290 microns, a geometric standard deviation of about 2.4, and a bulk density of about 700 g/l.

[Step 2] The freeflowing powder from the CB-30 mixer is fed continuously to a Lödige KM-600 mixer having four internal chopper assemblies along its length, each chopper assembly having three levels choppers of 4 blades each (4 cuts per chopper assembly level per chopper revolution). A surfactant paste blend of 48% NaAS paste (C14.5 sulfate, sodium salt; 75% active) and 58% NaAES paste (C14.5 ethoxy-1 sulfate, sodium salt; 75% active) is prepared, and is determined to have an apparent yield stress of 78 Pa at a shear rate of 1 $sec^{-1}$ and a temperature of 60° C., as measured using a Carrimed CSL −100 Controlled Stress Rheometer. The paste binder is continuously injected at a temperature of about 60° C. across the first three chopper assemblies at a total rate of about 182 kg paste/hr. Each paste stream to each chopper is subdivided into three smaller streams, each directed at a separate level of chopper, where each smaller stream has a discharge opening of 2 mm diameter. Each chopper turns at about 3500 RPM. The calculated mass of the discrete mass units of paste is about 0.024 grams, which is equivalent to a equivalent spherical diameter of about 3.5 mm. The conditions of the KM-600 mixer are as follows:

Mean residence time: about 60 seconds

Tip speed of plowshares: about 2 m/s

The resulting granular detergent agglomerates from the step 2 has a bulk density of about 550 g/l, a mean particle size of 720 microns, a geometric standard deviation of 1.9, and an anionic surfactant level of about 35% by weight. The agglomerates are processed using the optional process steps of drying and cooling in a fluidized bed, and sizing using particle separation means. After sizing, the resulting acceptable agglomerate ("accept"),rate is about 90% (10% by weight recycle), where the acceptable size range is a particle size between about 300 and 1700 microns The resulting acceptable agglomerates have a mean particle size of about 720 microns, a geometric standard deviation of the particle size distribution of about 1.7, and a bulk density of about 610 g/l. Unacceptable large particles are ground in a mill before recycling along with unacceptable fine particles back to step 1.

Example 3

[Step 1] 5400 kg/hr of liquid acid precursor HLAS (97% active) was continuously dispersed and mixed by the pin tools of a Littleford CB-100 mixer along with 12,040 kg/hr of finely ground soda ash (mean particle size of about 15 microns), 7200 kg/hr of powdered STPP, 3885 kg/hr of powdered sodium sulfate, and less that 20% (by weight of the CB mixer throughput) an internal recycle stream of powder from step 2. The acid precursor was fed at about 40° C., and the powders were fed at room temperature. The conditions of the CB-30 mixer were as follows:

Mean residence time: about 5 seconds.

Tip speed: about 12 m/s

The dry neutralization of the acid precursor by the carbonate in the presence of the other particulate material resulted in a free-flowing powder. The free-flowing powder had a mean particle size of about 250 microns, a geometric standard deviation of about 2.2, and a bulk density of about 680 g/l.

[Step 2] The free-flowing powder from the CB–100 mixer was fed continuously to a Lödige KM–15000 mixer with forward facing half-plows (i.e., Becker Blades), and having six internal chopper assemblies along its length, each chopper assembly having three levels of choppers, each chopper having 4 blades each (4 cuts per chopper assembly level per chopper revolution). A surfactant paste of NaAES paste was used as the agglomeration binder. The NaAES paste was the sodium salt of C14.5 ethoxy-3 sulfate (70% active) with an apparent yield stress of 135 Pa at a shear rate of 1 $sec^{-}$and a temperature of 25° C., as measured using a Carrimed CSL-100 Controlled Stress Rheometer. The paste binder was continuously injected at a temperature of about 30° C. across the first four chopper assemblies at a total rate of 1224 kg paste/hr. Each paste stream to each chopper assembly was subdivided into three smaller streams, each directed at a separate level of chopper, where each smaller stream had a discharge opening of 2 mm diameter. Each chopper turned at about 3500 RPM. The calculated average mass of the discrete mass units of paste was about 0.12 grams, which is equivalent to a equivalent spherical diameter of about 6 mm. The conditions of the KM-15000 mixer are as follows:

Mean residence time: about 16 seconds

Tip speed of Becker blades: about 4 m/s

The resulting granular detergent agglomerates from the step 2 has a bulk density of about 710 g/l, a mean particle size of 310 microns, a geometric standard deviation of 2.3, and an anionic surfactant level of about 24% by weight. At this point in the process, the fraction of fine particles less than 150 microns was about 15% by weight, and the fraction of oversize particles greater than 1180 microns was about 7% by weight. The agglomerates were further processed using the optional process steps of cooling in a fluidized bed, and sizing using particle separation means. After sizing, the resulting acceptable agglomerate ("accept") rate was about 85% (15% by weight recycle), where the acceptable size range was a particle size between about 150 and 1180 microns. The resulting acceptable agglomerates had a mean particle size of about 410 microns, a geometric standard; deviation of the particle size distribution of about 2.0, and a bulk density of about 750 g/l. Unacceptable large particles are ground in a mill before recycling along with unacceptable fine particles back to step 1.

What is claimed is:

1. A continuous process for preparing granular detergent agglomerate having a density of at least about 500 g/l, comprising the step of:

(a) in a first step, dispersing and mixing a liquid acid precursor of an anionic surfactant with a solid particulate water-soluble alkaline material in a high speed mixer for a mean residence time of about 0.2 to about 50 seconds, wherein the acid precursors is partly or totally neutralized, thereby forming a dry neutralized material comprising a salt of the anionic surfactant precursor in the form of a free-flowing powder; and (b) in a second step, dispersing and mixing an agglomeration binder which is a viscous surfactant paste having a shear-thinning rheology with an apparent yield stress ($t_y$) of greater than about 50 Pa with the free-flowing powder in a moderate speed mixer, said mixer having chopper blades operating at a tip speed of at least 3 m/sec, said agglomeration binder being dispersed directly at or slightly upstream from said chopper blades and dispersed as discrete mass units having an average equivalent diameter of from about 0.5 to about 4 mm, thereby agglomerating the powder into granular detergent agglomerates.

2. A process according to claim 1 wherein the viscous surfactant paste comprises an anionic surfactant selected from the group consisting of alkyl sulfate, alkyl ethoxy(1) sulfate, alkyl ethoxy(3) sulfate, linear alkylbenzene sulfonate, branched alkyl benzene sulfonate, and mixtures thereof.

3. A process according to claim 1 wherein the solid particulate water-soluble alkaline material is finely divided sodium carbonate having a mean particle size of less than about 20 microns.

4. A process according to claim 1 wherein the granular detergent agglomerates have a mean particle size of about 400 to 1000 microns, and a geometric standard deviation of less than 2.5.

5. A process according to claim 1 wherein the dry neutralized material is further mixed with an optional liquid and particulate detergent ingredients in an optional intermediate mixing step, before passing as the free-flowing powder into the mixer of the second step.

6. A process according to claim 1 wherein the dry neutralized material contains less than about 5% by weight detergent builder material.

7. A process according to claim 6 wherein the granular detergent agglomerates contain less than 5% by weight of detergent builder material.

* * * * *